US008263505B2

(12) United States Patent
Mortimer et al.

(10) Patent No.: US 8,263,505 B2
(45) Date of Patent: Sep. 11, 2012

(54) HYBRID FABRIC

(75) Inventors: Allen W. Mortimer, Hixson, TN (US); Yashavant Vinayak Vinod, Hockessin, DE (US)

(73) Assignee: INVISTA North America S.à r.l., Wilmington, DE (US)

( * ) Notice: Subject to any disclaimer, the term of this patent is extended or adjusted under 35 U.S.C. 154(b) by 544 days.

(21) Appl. No.: 11/839,738

(22) Filed: Aug. 16, 2007

(65) Prior Publication Data

US 2008/0318017 A1 Dec. 25, 2008

Related U.S. Application Data

(60) Provisional application No. 60/838,546, filed on Aug. 18, 2006.

(51) Int. Cl.
*D03D 15/00* (2006.01)
*B32B 5/02* (2006.01)
*B32B 5/08* (2006.01)

(52) U.S. Cl. ..... 442/208; 442/59; 442/189; 442/218

(58) Field of Classification Search ..... 442/208–216; 57/243

See application file for complete search history.

(56) References Cited

U.S. PATENT DOCUMENTS 3,577,615 A * 5/1971 LeNoir ..... 28/271
3,776,585 A * 12/1973 Bridgehouse ..... 294/74
5,720,322 A * 2/1998 Soderberg et al. ..... 139/420 A
6,105,224 A * 8/2000 O'Mara et al. ..... 28/271
6,750,162 B2 * 6/2004 Underwood et al. ..... 442/148
2002/0155773 A1 * 10/2002 Maini ..... 442/199

FOREIGN PATENT DOCUMENTS

GB 1167185 A * 12/1965

OTHER PUBLICATIONS

Kothari, V K and Gangal M K, Assessment of Frictional Properties of some woven fabrics, Indian Journal of Fiber and Textile Research, vol. 19, pp. 151-155, Sep. 19, 1994.*

Kawabata et al., "Objective Specification of Fabric Quality, Mechanical Properties and Performance", The Textile Machinery Society of Japan, 1982, Kyoto, Japan.

* cited by examiner

*Primary Examiner* — Jennifer A Steele

(74) *Attorney, Agent, or Firm* — Christina W. Geerlof

(57) ABSTRACT

This disclosure relates to a "hybrid" fabric made from a textured multifilament yarn in combination with an untextured multifilament yarn. The portion of multifilament yarns comprising this hybrid fabric are substantially without bulk or texture while the textured portion of multifilament yarns comprising the fabric have bulk. Such hybrid fabrics from this combination of yarns retain substantially similar abrasion resistance and tactility of a fabric made entirely of high tenacity air textured multifilament yarns. Nylon woven hybrid fabrics disclosed herein provide excellent properties especially for uses in apparel, rucksacks, softsided luggage, duffle bags, tenting and the like.

12 Claims, 1 Drawing Sheet

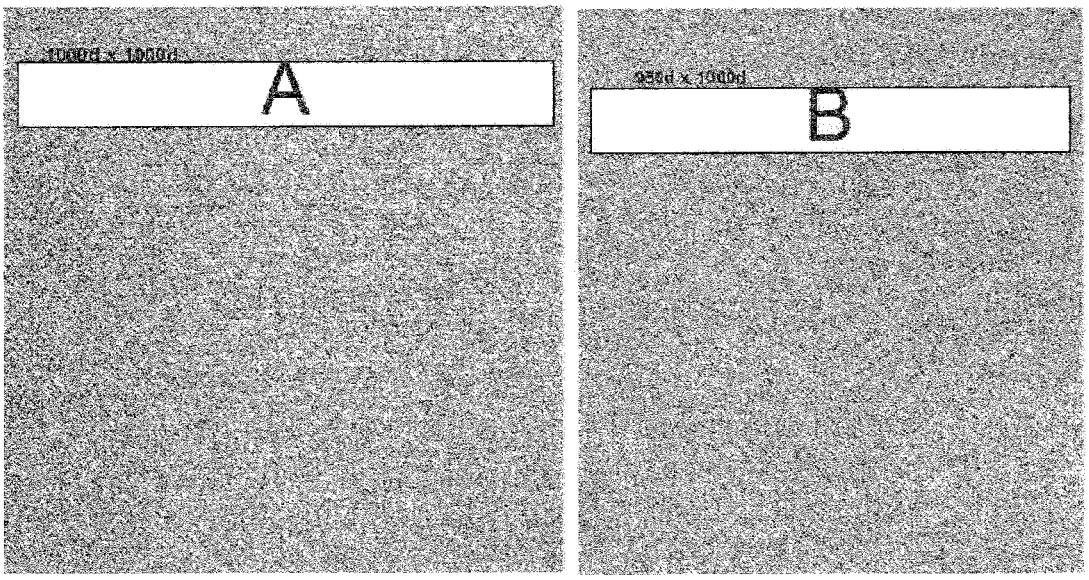
1000d x 1000d
A
958d x 1000d
B

HYBRID FABRIC

CROSS-REFERENCE TO RELATED APPLICATIONS

This application claims benefit of priority from Provisional Application No. 60/838,546 filed Aug. 18, 2006. This application hereby incorporates by reference Provisional Application No. 60/838,546 in its entirety.

FIELD OF THE INVENTION

Herein disclosed is a fabric made from a high tenacity air textured multifilament yarn in combination with a high tenacity multifilament yarn. A portion of multifilament yarns which comprise the fabric are substantially without bulk or texture while the air textured portion of multifilament yarns comprising the fabric have bulk. Such "hybrid" fabrics from this combination of yarns retain substantially similar abrasion resistance and tactility of a fabric made entirely of high tenacity air textured multifilament yarns. Nylon woven "hybrid" fabrics disclosed herein provide excellent properties especially for uses in rucksacks, soft sided luggage, duffle bags, apparel and the like.

BACKGROUND OF THE INVENTION

Woven fabrics produced from bulky air textured yarns are certified as CORDURA® branded fabrics (CORDURA® is a registered trademark for durable fabrics of INVISTA S. à r. I., Three Little Falls Centre, 2801 Centreville Road, Wilmington, Del., 19808, USA). These fabrics comprise high tenacity air jet textured nylon multifilament yarns are used in luggage, backpacks, duffle bags, work-wear apparel, shoes and applications where a high strength and durable fabric is desirable. In addition, conventional dye stuffs for nylon can be used to dye CORDURA® fabrics made from high tenacity nylon multifilament yarns. Alternatively, CORDURA® fabrics are provided from yarns which are "solution dyed." Solution dyed means having a pigment coloration compounded with the polymer where after dyeing the yarn or fabric is not needed or desirable. CORDURA® fabrics are often coated on at least one surface with coating materials and films employed in the art, e.g. perfluoropolymers, polyurethanes, latex, acrylics and silicones. In general such coatings impart a further resistance of the fabric to liquid penetration, staining and soiling. CORDURA® fabrics are often coated on at least one surface with coating materials and films employed in the art, e.g. perfluoropolymers, polyurethanes, latex, acrylics and silicones. In general such coatings impart a further resistance of the fabric to liquid penetration, staining and soiling.

SUMMARY OF THE INVENTION

An illustrative embodiment provided by the teachings herein is a fabric of multifilament yarns comprising at least a first yarn in a first fabric direction and at least a second yarn in a fabric direction perpendicular to the first direction and wherein the yarn in the first direction is chosen to have substantially minimal bulk and the second yarn is chosen to have a bulk level in a range of about 6 $cm^3$/gram to about 12 $cm^3$/gram.

Another illustrative embodiment provided by the teachings herein is a woven fabric of nylon multifilament yarns comprising a warp yarn and a weft yarn comprising a warp yarn chosen to have substantially minimal bulk and the weft yarn having a bulk level in a range of about 6 $cm^3$/gram to about 12 $cm^3$/gram.

Another illustrative embodiment provided by the teachings herein is a woven fabric of nylon multifilament yarns comprising a warp yarn and a weft yarn comprising a weft yarn chosen to have substantially minimal bulk and the warp yarn having a bulk level in a range of about 6 $cm^3$/gram to about 12 $cm^3$/gram.

Another illustrative embodiment provided by the teachings herein is a fabric of multifilament yarns comprising at least a first multifilament yarn in a first fabric direction and at least a second multifilament yarn in a fabric direction perpendicular to the first direction and wherein the yarn in the first direction is chosen to have a tenacity in a range of about 1.7 to 6.3 grams per denier and the second yarn is chosen a tenacity in a range of about 2 to 7.5 grams per denier.

Another illustrative embodiment provided by the teachings herein is a fabric of comprising first multifilament yarns chosen to have a tenacity of about 20% to about 25% greater than the tenacity of the second multifilament yarns.

BRIEF DESCRIPTION OF THE FIGURE

FIG. 1 is a representation of two dyed fabrics identified as A and B.

DETAILED DESCRIPTION OF THE INVENTION

According to an illustrative embodiment, a fabric comprising two different yarns is provided. The two different yarns comprising the fabric embodiment can be at least one of textured (bulky) type and at least one of untextured (having minimal bulk) type. More generally, the two different yarns are processed into a "hybrid" fabric where a textured (bulky) type yarn predominates in a first direction of the fabric and the untextured (having minimal bulk) type predominates in a second direction of the fabric perpendicular to the first direction of the fabric.

According to an illustrative embodiment, a fabric comprising two different yarns woven in warp and weft directions is provided. The two different yarns comprising the woven fabric embodiment can be at least one of textured (bulky) type and at least one of a substantially untextured (having minimal bulk) type. More generally, the two different yarns are processed into a fabric where a textured (bulky) type yarn predominates in a warp direction of the fabric and the substantially untextured (having minimal bulk) type predominates in a weft of the fabric.

According to an illustrative embodiment, the two different yarns are processed into a fabric where a textured (bulky) type yarn predominates in a weft direction of the fabric and the substantially untextured (having minimal bulk) type predominates in a warp of the fabric.

According to a more general illustrative embodiment, fabrics of such two different yarns (textured and substantially untextured) have a visual aesthetic of at least equal to but generally superior to known fabrics comprised substantially of bulked yarns (air jet textured multifilament yarns).

According to a more general illustrative embodiment, the fabrics provide for a substantial absence of "warp streaks", as revealed by diagnostic dyeing and visual rating. Such fabrics are advantageously used in certain apparel applications, e.g. work wear and military uniforms. One such advantage is at least the economical production of fabrics having only a portion of the yarns air jet textured. Back packs (rucksacks), active wear apparel, shoes, boots and duffle bags are especially well-suited to construction from the fabrics of the general illustrative embodiment.

According to a more general illustrative embodiment, the fabric comprises a portion of substantially untextured yarns having a yarn tenacity equal to 20% and greater than the tenacity of the air jet textured yarns comprising the remainder of the fabric. Such fabrics have the aesthetics (i.e. look and feel) of a 100% warp×weft air jet textured fabric, but with superior tensile strength properties in the direction of the substantially untextured yarn component.

It is believed by those skilled in the art that some processes of air jet texturing to impart bulk into yarn can reduce yarn tenacity by as much as 20-25%. By not texturing a portion of component yarns in the fabric, the fabric strength can be improved. This improvement in fabric strength can be nearly equivalent to the amount of improvement in yarn tenacity obtained by not air jet texturing.

According to a more general illustrative embodiment, the fabric abrasion resistance (a factor of yarn tenacity and yarn bulk) is reduced somewhat, but substantially unchanged from fabrics comprising air jet textured bulky yarns in both warp and weft directions. In general, abrasion resistance may be reduced by lowering the bulk, but the higher tenacity of unbulked warp yarns provides this substantially unchanged abrasion resistance.

An illustrative embodiment provided by the teachings herein is a fabric of multifilament yarns comprising at least a first yarn in a first fabric direction and at least a second yarn in a fabric direction perpendicular to the first direction and wherein the yarn in the first direction is chosen to have substantially minimal bulk and the second yarn is chosen to have a bulk level in a range of about 6 $cm^3$/gram to about 12 $cm^3$/gram.

Another illustrative embodiment provided by the teachings herein is a woven fabric of nylon multifilament yarns comprising a warp yarn and a weft yarn comprising a warp yarn chosen to have substantially minimal bulk and the weft yarn having a bulk level in a range of about 6 $cm^3$/gram to about 12 $cm^3$/gram.

Another illustrative embodiment provided by the teachings herein is a fabric of multifilament yarns comprising at least a first multifilament yarn in a first fabric direction and at least a second multifilament yarn in a fabric direction perpendicular to the first direction and wherein the yarn in the first direction is chosen to have a tenacity in a range of about 1.7 to 6.3 grams per denier and the second yarn is chosen a tenacity in a range of about 2 to 7.5 grams per denier.

Another illustrative embodiment provided by the teachings herein is a fabric of comprising first multifilament yarn chosen to have a tenacity of about 20% greater than the tenacity of the second multifilament yarn.

Other illustrative embodiments of the hybrid fabric may be chosen from woven having a plain weave, a 2 by 2 twill weave and ripstop weave. The hybrid fabric may be colored using known methods chosen from dyeing and printing. The hybrid fabric may comprise yarns chosen from solution dyed yarns. The hybrid fabric may comprise yarns chosen from synthetic polyamides, synthetic polyesters, acrylics, cotton, and wool. The hybrid fabric may comprise yarns chosen from yarns of about 300 denier to about 1500 denier. The hybrid fabric may comprise yarns chosen from multifilament yarns of about 2 denier per filament to about 10 denier per filament. The hybrid fabric may comprise fabrics having a basis weight chosen from about 240 grams per square meter to about 410 grams per square meter.

Another illustrative embodiment provided by the teachings herein is an article comprising a hybrid fabric wherein the article is chosen from apparel, soft sided luggage, rucksacks, duffle bags and tents. The article may further comprise a hybrid fabric coated on at least one surface with a coating material or film chosen from polyurethanes, latex, acrylics and silicones.

The air jet textured yarns herein disclosed are available from INVISTA™ S. à r. I., Three Little Falls Center, 2801 Centerville Road, Wilmington, Del. USA 19808. In general, such textured multifilament yarns are distinguished by their bulk level versus an untextured yarn. Bulk in the yarn is obtained by leading the yarn through an air jet at a rate faster than it is drawn off on the far side of the jet. In the jet, the yarn multifilament structure is opened, loops are formed, and the structure is closed again. Some loops are locked inside and others are locked on the surface of the yarn. The net effect is that these textured yarns are characterized by a volume per unit mass (e.g. measured in cubic centimeters per gram) higher than the volume per unit mass of a substantially untextured yarn. An untextured yarn is one having a closed multifilament structure having substantially no loop structure which results in minimal bulk. Textured yarn bulk can be measured by a method based on cutting a length of sample, weighing the sample and determining the volume of the substantially uncompacted sample.

Test Methods

Fabric "Grab Strength" according to ASTM D5034. A test specimen of 4 inch (10 cm) width and at least 6 inch (15 cm) long is clamped with jaws 1 inch (2.54 cm) wide and centered across the test specimen width at 3 inches (7.6 cm) apart. The breaking strength obtained includes any reinforcing effects of the fabric not held by the clamping jaws. The strength is reported in pounds of force (4.447 Newtons per pound).

Fabric "Tear Strength" according to ASTM D2261.

Abrasion (Taber) according to ASTM D3884.

Abrasion (Wyzenbeek) according to ASTM D4157.

KES Test Method for Fabric Evaluation: The method is disclosed in the publication entitled "Objective Specification of Fabric Quality, Mechanical Properties and Performance" edited by S. Kawabata, R. Postle, and M. Niwa—published by The Textile Machinery Society of Japan, 1982; Osaka Science and Technology Center Bid., 8-4, Utsbo-1-chome, Nishi-ku, Osaka 550 Japan.

The KES Test Method determines fabric surface characteristics expressed in terms of: MIU—Coefficient of friction; MMD—Mean deviation of MIU; SMD—Geometrical roughness (micrometers).

Yarn tensile testing (with percent elongation at break) may be performed according to ASTM D2256 with the use of a INSTRON universal materials tensile testing instrument using CRE machine, Option 1A; D1907 Option 1 denier for calculations. The nominal yarn tenacity for 500 denier yarn used herein is 22.2 Newtons (4.52 grams per denier) and for 1000 denier yarn used herein is 46.3-48 Newtons (4.72 to 4.89 grams per denier).

Yarn denier (grams per 9000 meters) is measured in the known manner (ASTM 1059) using a cut and weigh apparatus for measuring linear densities. The decitex, another linear density expression is in grams per 10 000 meters.

EXAMPLES

For the purpose of comparison to an example of an illustrative embodiment, a fabric was woven using a conventional weaving loom in a plain weave. The warp yarns were multifilament nylon high tenacity air jet bulked of 1000 denier and 140 filaments per yarn. The fill (weft) yarns were the same bulked of 1000 denier and 140 filaments per yarn. Each yarn had a nominal bulk level of 10.5 $cm^3$/gram. The thread count was 34 warp yarns per inch×28 weft yarns per inch (13.4 per cm×11 per cm). This fabric basis weight was 8.23 ounces per square yard (0.279 kilogram/square meter). This fabric had grab strength in the warp direction of 620.68 pounds (281 kilograms) and in the weft direction a grab strength of 516.66 pounds (234 kilograms). This fabric is suitable for certification as a CORDURA® fabric.

TABLE 1

| CFS-83-10(CORDURA ® fabric of air jet textured yarns); Style GF 1091 - 28 |
|---|
| WT - 8.23 oz/$yd^2$ = 279 grams per square meter<br>Weave - Plain; No size<br>Warp yarn: 1000 denier/140 filaments - 440 bright air jet textured nylon 66*<br>Weft: 1000 denier/140 filaments - 440 bright air jet textured nylon 66* |

*available from INVISTA ™ S.àr.l., Three Little Falls Center, 2801 Centerville Road, Wilmington, Delaware USA 19808.

As an example of an illustrative embodiment, a fabric was woven using a conventional weaving loom in a plain weave according to known methods. The warp yarns of the woven fabric were multifilament nylon high tenacity un-bulked yarn of 950 denier and 140 filaments per yarn. The weft (fill) yarns of the woven fabric were an air-jet bulked yarn of 1000 denier and 140 filaments per yarn, their nominal bulk level was 10.5 $cm^3$/gram. The yarns were woven with sizing applied in the known manner. The sizing was an aqueous polyacrylic acid known for use with nylon yarns, e.g. ABCO Plasticryl® (A-34. The thread count (Warp×Fill) in ends-per-inch was 33.5 warp yarns per inch×28 weft yarns per inch (13.2 per cm×11 per cm). This "hybrid" finished fabric was 8.05 ounces per square yard (0.273 kilogram/square meter). This "hybrid" fabric had grab strength in the warp direction of 730.43 pounds (331 kilograms) and in the fill direction a grab strength of 519.07 pounds (235 kilograms).

TABLE 2

| CFS 83-11 (Hybrid - Flat warp, air jet textured weft); Style GF 950-28 |
|---|
| Wt - 8.05 oz/$yd^2$ = 273 grams per square meter<br>Weave - Plain;<br>Size - ABCO Plasticryl A-34<br>Warp yarn: 950 denier/140 filaments R20 Bright HT nylon 66**<br>Weft yarn: 1000 denier/140 filaments 440 bright air jet textured nylon 66* |

*available from INVISTA ™ S.àr.l., Three Little Falls Center, 2801 Centerville Road, Wilmington, Delaware USA 19808.
**available from INVISTA ™ S.àr.l., Three Little Falls Center, 2801 Centerville Road, Wilmington, Delaware USA 19808.

TABLE 3

| KES Testing for Fabric Tactile Properties | Warp direction measurements | Weft direction measurements |
|---|---|---|
| CFS-83-10 Hybrid Fabric untextured warp and air jet textured weft | MIU = 0.169<br>MMD = 0.0305<br>SMD = 19.26 | MIU = 0.222<br>MMD = 0.0407<br>SMD = 13.40 |
| CFS-83-11 CORDURA ® Fabric warp and weft | MIU = 0.161<br>MMD = 0.0408<br>SMD - 20.00 | MIU = 0.223<br>MMD = 0.0277<br>SMD = 8.24 |

Using the standard KES Testing Methods for Fabric Tactile Properties two fabric samples were tested; the results are posted in Table 3. The "hybrid fabric" is an illustrative embodiment having an air jet textured weft yarn and an untextured warp yarn. The CORDURA® fabric data is provided for comparison. These data show little difference in the values for MIU (coefficient of friction) as this is largely a material property. MMD the mean deviation of the coefficient of friction is lower for CFS-83-11 than for CFS-83-10 in the weft direction. The same is true for the weft direction SMD (surface roughness) measurements. It is believed these data account for the perception of improved smoothness for the hybrid fabric (CFS-83-11) versus the CORDURA® fabric (CFS-83-10) found by a panel of fabric rating experts.

Diagnostic Dyeing Procedure

The fabrics (both CFS-83-11 and CFS-83-10) were prescoured at 72° C. for 30 minutes in a bath comprising 1 gram per liter Merpol HCS (non-ionic wetting agent) and 1 gram per liter trisodium phosphate. These fabric dyeing were performed in a bath at 27° C. with 5 gram per liter monosodium phosphate at pH 5. The fabric and dye bath was maintained for 5 minutes followed by addition of a pre-dissolved dyestuff 1% Nylosan Violet F-BL and maintained for 5 minutes. The dye bath was raised in temperature to 100° C. and maintained for 30 minutes. Afterwards, the bath and fabric were cooled to 76° C. The fabric was removed, rinsed of dyestuffs and auxiliaries and dried. The woven and dyed fabric was rated for uniformity by a panel of experts in diagnostic dyeing. The panel concluded that the "hybrid" fabric having with the unbulked warp yarns and air jet textured weft yarns dyed to a more uniform coloration in comparison to a fabric similarly prepared using CORDURA® fabric (CFS-83-10 fabric). FIG. 1 is a representation of the diagnostic dyeing results for the two fabrics A and B. In FIG. 1 this hybrid fabric (CFS-83-11) embodiment is designated as B and the CORDURA® fabric (CFS-83-10) is designated as A.

The foregoing disclosure constitutes a description of specific embodiments illustrating how the invention may be used and applied. Such embodiments are only exemplary. The invention in its broadest aspects is further defined in the claims which follow. These claims and terms used therein are to be taken as variants of the invention described. These claims are not restricted to such variants but are to be read as covering the full scope of the invention implicit within the disclosure herein.

The invention claimed is:

1. A woven hybrid fabric of nylon multifilament yarns comprising a multifilament warp yarn and a multifilament weft yarn comprising a warp yarn having substantially minimal bulk and the weft yarn having a bulk level in a range of about 6 $cm^3$/gram to about 12 $cm^3$/gram.

2. The woven hybrid fabric of nylon multifilament yarns of claim 1 wherein the multifilament weft yarn has a tenacity in a range of about 1.7 to 6.3 grams per denier and the multifilament warp yarn has a tenacity in a range of about 2 to 7.5 grams per denier.

3. The woven hybrid fabric of nylon multifilament yarns of claim 1 wherein the multifilament warp yarns having a tenacity of about 20% greater than the tenacity of the weft multifilament yarns.

4. The woven hybrid fabric of nylon multifilament yarns of claim 1 comprising at least one woven chosen from a plain weave, a 2 by 2 twill weave and ripstop weave.

5. The woven hybrid fabric of nylon multifilament yarns of claim 1 wherein the multifilament yarns are solution dyed yarns.

6. The woven hybrid fabric of nylon multifilament yarns of claim 1 wherein said fabric is a dyed or printed fabric.

7. The woven hybrid fabric of nylon multifilament yarns of claim 1 wherein said nylon multifilament yarns are of about 300 denier to about 1500 denier.

8. The woven hybrid fabric of nylon multifilament yarns of claim 1 wherein said nylon multifilament yarns are of about 2 denier per filament to about 10 denier per filament.

9. The woven hybrid fabric of nylon multifilament yarns of claim 1 wherein said fabric has a basis weight chosen from about 240 grams per square meter to about 410 grams per square meter.

10. An article comprising the woven hybrid fabric of nylon multifilament yarns of claim 1 chosen from apparel, soft sided luggage, rucksacks, duffle bags, boots and tents.

11. The article of claim 10 where the woven hybrid fabric is coated on at least one surface with a coating material or film chosen from perfluoropolymers, polyurethanes, latex, acrylics and silicones.

12. A woven hybrid fabric of multifilament yarns comprising a nylon multifilament warp yarn and a nylon multifilament weft yarn comprising a warp yarn having substantially minimal bulk and the weft yarn having a bulk level in a range of about 6 $cm^3$/gram to about 12 $cm^3$/gram, wherein the yarns are chosen from yarns of about 300 denier to about 1500 denier.

* * * * *